US008733303B2

(12) United States Patent
Lanfranco et al.

(10) Patent No.: US 8,733,303 B2
(45) Date of Patent: May 27, 2014

(54) METHOD FOR CONTROLLING A VALVE CONTROL SYSTEM WITH VARIABLE VALVE LIFT OF AN INTERNAL COMBUSTION ENGINE BY OPERATING A COMPENSATION IN RESPONSE TO THE DEVIATION OF THE CHARACTERISTICS OF A WORKING FLUID WITH RESPECT TO NOMINAL CONDITIONS

(71) Applicant: C.R.F. Societa Consortile Per Azioni, Orbassano (IT)

(72) Inventors: Claudio Lanfranco, Orbassano (IT); Mitzi Puccio, Orbassano (IT)

(73) Assignee: C.R.F. Societa Consortile per Azioni, Orbassano (Torino) (IT)

( * ) Notice: Subject to any disclaimer, the term of this patent is extended or adjusted under 35 U.S.C. 154(b) by 0 days.

(21) Appl. No.: 13/738,276

(22) Filed: Jan. 10, 2013

(65) Prior Publication Data

US 2013/0284133 A1 Oct. 31, 2013

(30) Foreign Application Priority Data

Apr. 26, 2012 (EP) ..... 12165785

(51) Int. Cl.
*F01L 9/02* (2006.01)

(52) U.S. Cl.
USPC ..... 123/90.12; 123/90.13; 137/485; 137/487.5

(58) Field of Classification Search
USPC ..... 123/90.12, 90.13; 137/485, 487.5
See application file for complete search history.

(56) References Cited

U.S. PATENT DOCUMENTS

| | | | | |
|---|---|---|---|---|
| 8,230,830 | B2 * | 7/2012 | Vattaneo | 123/90.12 |
| 2010/0326384 | A1 | 12/2010 | Vattaneo | |

FOREIGN PATENT DOCUMENTS

| | | |
|---|---|---|
| EP | 0 446 065 | 9/1991 |
| EP | 1 378 636 | 1/2004 |
| EP | 1 338 764 | 3/2004 |
| EP | 1 243 763 | 8/2004 |
| EP | 1 091 097 | 3/2005 |
| EP | 1 635 045 | 12/2006 |
| EP | 1 555 398 | 2/2007 |
| EP | 1 344 900 | 3/2007 |
| EP | 2 072 791 | 6/2009 |
| FR | 2 844 828 | 3/2004 |
| JP | 4 292506 | 10/1992 |

OTHER PUBLICATIONS

Search Report for EP 12165785.2 dated Dec. 7, 2012.

* cited by examiner

*Primary Examiner* — Ching Chang
(74) *Attorney, Agent, or Firm* — Nixon & Vanderhye P.C.

(57) ABSTRACT

A method controls a valve-control system for variable-lift actuation of the valves of an internal-combustion engine, in which the valve-control system includes, for each cylinder of the engine, a solenoid valve for controlling the flow of a hydraulic fluid in the system, and designed manner for determining a real temperature value of the hydraulic fluid. The method includes determining a deviation of performance of the solenoid valves due to a degradation of the characteristics of the hydraulic fluid with respect to nominal values thereof, and substituting for the real temperature value an equivalent temperature value consisting of a temperature value at which the hydraulic fluid having nominal characteristics would produce performance of the solenoid valves corresponding to the performance resulting from the deviation so that each solenoid valve is governed as a function of the equivalent temperature value.

15 Claims, 7 Drawing Sheets

METHOD FOR CONTROLLING A VALVE CONTROL SYSTEM WITH VARIABLE VALVE LIFT OF AN INTERNAL COMBUSTION ENGINE BY OPERATING A COMPENSATION IN RESPONSE TO THE DEVIATION OF THE CHARACTERISTICS OF A WORKING FLUID WITH RESPECT TO NOMINAL CONDITIONS

This application claims priority to EP Patent Application No. 12165785.2 filed 26 Apr. 2012, the entire content of which is hereby incorporated by reference.

FIELD OF THE INVENTION

The present invention relates to a method for controlling a valve-control system for variable-lift actuation of the valves of a reciprocating internal-combustion engine, wherein said valve-control system comprises, for each cylinder of said reciprocating engine, a solenoid valve for controlling the flow of a hydraulic fluid in said valve-control system, and further comprises means configured for determining a real temperature value of said hydraulic fluid.

PRIOR ART

Systems of the type specified above have been described and illustrated in numerous prior patents filed in the name of the present applicant, such as for example, the European patent No. EP 1555398 B1.

With reference to the annexed FIG. 1, a valve-control system of a hydraulic type for variable-lift actuation of the valves (for a reciprocating internal-combustion engine) developed by the present applicant and designated by 1 comprises a pair of valves 2 mobile along the respective axes and co-operating with respective elastic-return elements 3 designed to recall each valve into a closed position. Each valve is operatively connected for actuation to a respective actuator 4. The system 1 further comprises hydraulic means including a variable-volume pressurized-fluid chamber C, channels 4*a* hydraulically connected to the respective actuators 4, and a channel 5 hydraulically connected to the channels 4*a* and to the pressurized-fluid chamber C.

A pumping piston 6 faces the inside of the pressurized-fluid chamber C, the walls of which are defined by a cylinder 6*a* and by the pumping piston 6 itself. An elastic element 6*b* is set coaxial to the pumping piston 6 and to the cylinder 6*a* and set between them.

The person skilled in the branch will appreciate that the piston 6 and the chamber C define a pumping unit of the system 1, designed to send—as will be described—pressurized fluid to each hydraulic actuator 4.

Mobile within the cylinder 6*a*, which is fixed, is the piston 6 governed by a tappet 7, preferably a rocker, which is in turn governed by a cam 8 carried by a camshaft 9 that can turn about its own axis. The rocker 7 comprises a cam-follower roller 7*a* and a fulcrum 7*b*.

In preferred embodiments, the cam 8 comprises a main lobe 10 and a secondary lobe 10*a*. If the cam 8 governs the intake valves, the secondary lobe 10*a* has a phasing anticipated with respect to the main lobe 10.

A solenoid valve 11 governed by electronic control means, not illustrated, controls connection of the pressurized-fluid chamber C and of the actuators 4 with a first tank 12 that defines an exhaust environment. In other words, the solenoid valve 11 is configured for selectively isolating or setting in communication the hydraulic supply line constituted by the channels 4*a*, 5 and the exhaust environment constituted by the tank 12.

The annexed drawings do not show the details of construction of the actuators 4, in so far as said details can be obtained as illustrated in the prior patents filed in the name of the present applicant, such as, for example EP1243763 B1, EP1338764 B1, EP1635045 B1, and also in order to render the drawings more readily understandable.

In a preferred embodiment, the tank 12 is provided with means for bleeding air, for example, a hole 13 made at the top. The first tank 12 is supplied with a hydraulic working fluid, preferably oil coming from a lubricating circuit of the engine on which the system 1 is installed, by means of a hydraulic-feed channel 14 coming under it, which branches off from a manifold channel 14*a*, and by means of a first one-way valve 15.

The one-way valve 15 is designed to enable a flow of fluid only towards the tank 12. A hydraulic accumulator 16 is hydraulically connected to the tank 12 by means of a channel 16*a*.

A main characteristic of operation of systems for variable actuation of valves of this type is the possibility of decoupling the motion of the valves 2 from the motion of the tappet 7 imposed by the cam 8. In particular, the system 1 governs the valves 2, which are thus variable-actuation valves, via the aforesaid hydraulic means, i.e., via the pressurized-fluid chamber C, the channels 4*a*, 5, the actuators 4, and the solenoid valve 11.

The oil flows to the system from the manifold channel 14*a* and enters the hydraulic-feed channel 14. Once the one-way valve 15 has been passed, the oil reaches the tank 12. The aforesaid hydraulic means are normally filled completely with the oil, but the amount of oil inside them can vary according to the actuation needs, as will be described in detail in what follows.

The pressurized-fluid chamber C has a volume that can be varied by actuation of the piston 6 via the tappet 7. In particular, when the cam 8 governs actuation of the tappet 7, this transfers the motion to the pumping piston 6, which generates a rate of flow of oil within the channel 5 directed towards the solenoid valve 11 and the channels 4*a*.

The action of the tappet 7 is countered by the pressure within the fluid chamber C and by the action of the elastic element 6*b*.

The oil in this way reaches the actuators 4 that govern a lift of the valves 2.

A necessary condition for being able to govern a lift of the valves 2 is that the solenoid valve 11 be kept, by means of an electrical signal, in the closed configuration. The term "closed configuration" is meant to define a condition in which the solenoid valve 11 isolates the tank 12 from the channels 5, 4*a* and hence from the pressurized-fluid chamber C and the actuators 4. In this way, the entire rate of flow of oil generated by the motion of the pumping piston 6 is sent to the actuators 4 that govern the valves 2.

In the case where the solenoid valve 11 is switched, by interruption of the aforesaid electrical signal, in an open configuration, i.e., in a condition such that the solenoid valve 11 makes a hydraulic connection between the tank 12 and the channels 4*a*, 5 and the pressurized-fluid chamber C, the oil generated by the pumping piston 6 flows out through the solenoid valve 11 towards the tank 12 and possibly towards the hydraulic accumulator 16. In this way, a depressurization of the pressurized-fluid chamber C and of the channels 4*a*, 5 is brought about. It should moreover be noted that, irrespective of the configuration of the solenoid valve 11, the channels 4*a*, 5 are always hydraulically connected together.

Consequently, if the solenoid valve 11 is in the open configuration, the actuators 4 are not able to develop a force of actuation on the valves 2 that is able to counter the action of elastic return produced by the elastic-return elements 3, which cause rapid closing of the respective valve 2 countered only by the action of a hydraulic brake (not illustrated) within each actuator 4.

The details of construction of the aforesaid hydraulic brake are not illustrated in the annexed figures in order to simplify understanding thereof and in so far they are in themselves known, for example, from the documents Nos. EP 1 091 097 B1 and EP 1 344 900 B1.

Hence, it is possible to decouple selectively the motion of the valves 2 from the motion of the tappet 7 by acting on the solenoid valve 11 and connecting the actuators 4 and the pressurized-fluid chamber C to an exhaust environment defined by the tank 12. The decoupling performed in this way, enables variation of the lift and/or the instants of opening and closing of the valves 2 both between successive engine cycles and within one and the same cycle.

For actuation of the solenoid valve 11 a method illustrated in the block diagram of FIG. 2 is generally used. In said calculation method, once the values of crank angle θ_OP,CA and θ_CL,CA for which there is required, respectively, an opening and a closing of the valves 2 are known, values of crank angle designated by θ_CL,E and θ_OP,E are determined, which are values of the crank angle at which, respectively, the electrical signal to the solenoid valve 11 is imparted and ceases. It should be noted that the solenoid valve 11 is of the normally open type; consequently, the electrical signal causes a switching thereof into the closed position.

On account of the physics of the system, the value θ_CL,E is phase shifted in advance with respect to the value θ_OP,CA, as likewise the value θ_OP,E is phase shifted in advance with respect to the value θ_CL,CA, the reason being that the electrical signals must travel towards the solenoid valve with sufficient advance to compensate for the effects of the delays in the control chain due to a plurality of factors.

The factors that intervene in the calculation differ according to the event that regards the valves 2. In particular, in the case where the event is valve opening, the procedure for calculating the angle θ_CL,E is described schematically in block OP. Among the variables at input to block OP (and as a function of which the value θ_CL,E is calculated) are, in addition to the aforesaid value of crank angle θ_OP,CA (known and reset, for example, being stored on a map in the engine control unit) at which opening of the valves 2 is desired, the following quantities:

- the temperature of the oil inside one of the actuators 4, here designated by T_OIL,AC;
- the temperature of the oil inside the solenoid valve 11, here designated by T_OIL,SV;
- the voltage across the battery of the vehicle on which the internal-combustion engine is installed, here designated by VBATT; and
- r.p.m. of the internal-combustion engine, here designated by n.

The temperature of the oil inside the solenoid valve T_OIL,SV is in turn determined through a calculation algorithm represented schematically by block CALC starting from the value of oil temperature T_OIL,AC in one of the actuators 4.

The value T_OIL,AC is determined by sensor means for detecting the temperature of the hydraulic fluid TS (generally located in a position corresponding to an actuator 4) that are in themselves known or by means of an estimation algorithm based upon engine-operating parameters of a conventional type such as, for example, engine r.p.m. and the temperature of the cooling liquid.

It is likewise possible to determine the temperature T_OIL,AC via combined use of the means referred to above, i.e., the sensor TS and the estimation algorithm. This may prove useful, for example, in the case where the sensor TS is located in a position corresponding to a portion of the system subject to phenomena of perturbation or generally such that it is necessary to make a comparison with another datum to guarantee a higher accuracy and reliability of the signal.

The combined use may moreover prove useful in the case where, as further example, the sensor TS were to present a failure: in this case, the temperature of the hydraulic fluid estimated using the aforesaid algorithm would in any case enable regular operation of the valve-control system and of the engine itself.

In any case, whatever the means chosen for its determination, the temperature of the oil T_OIL,AC in the actuator 4 represents the real temperature of the hydraulic fluid in the system.

By analogy, also the temperature T_OIL,SV is a real temperature value of the hydraulic fluid, whether it is determined by the algorithm represented schematically by block TCALC or by means of a dedicated sensor.

In fact, it should be noted that in other embodiments positioning of the temperature sensor (or sensors) TS in a position closer to, or even corresponding to, the solenoid valve 11 (instead of in a position corresponding to the actuator 4) is possible so that it is no longer necessary to calculate the temperature T_OIL,SV.

The voltage across the battery VBATT and the temperature of the oil in the solenoid valve 11 T_OIL,SV concur to determining the nominal closing time of the solenoid valve 11, here designated by t_NOM,CL. In fact, the nominal closing time is a function of:

- the physical characteristics of the oil at a given operating temperature, as a function of which, among other things, the hydraulic resistances encountered during the movement of the mobile parts of the solenoid valve 11 vary; and
- the supply voltage of the solenoid valve itself, which depends upon the voltage across the battery and in general determines the rapidity with which the solenoid of the solenoid valve 11 is energized.

The engine r.p.m. n, the temperature of the oil in the actuators T_OIL,AC, and the value of crank angle θ_OP,CA itself concur in determining a delay due to the compressibility of the oil and designated in FIG. 2 by DEL_COMP.

In fact, the effects of the compressibility of the oil, which always correspond to a delay of response of the system with respect to the ideal condition of incompressibility, are variable as a function of the aforesaid three quantities, namely:

- to higher r.p.m. n of the internal-combustion engine there correspond lower effects of delay due to compressibility in so far as the system becomes physically more "rigid" on account of the high operating rates of the various components and of the columns of fluid;
- as a function of the crank angle at which it is desired to open the solenoid valve, the effects of the compressibility can vary since it can happen that the system operates in late-valve opening (LVO) regime, during which there is an effective compression of the oil when the pumping piston 6 has already covered part of its stroke; in this situation, the volume of oil to be compressed is decidedly less than what would be obtained in conditions of normal opening; consequently, the effect of delay induced by the compressibility will be less marked; with a larger volume, the effect due to "elasticity", hence to compressibility of the oil, is more pronounced.

As illustrated in block OP, the values thus determined of the nominal closing time t_NOM,CL and of the delay due to the compressibility of the oil DEL_COMP are subtracted from the crank angle θ_OP,CA and added to the result of said operation is a quantity, once again expressed in terms of degrees of crank angle, corresponding to a closed-loop compensation of the difference between the nominal closing time t_NOM,CL and a closing time measured for each solenoid valve 11. Said amount of compensation is here designated by C_COMP,CL.

It should be noted that the values t_NOM,CL, DEL_COMP and C_COMP,CL are expressed in terms of degrees of crank angle, where this is intended to indicate also that, in the case where the physical dimensions of said quantities do not correspond to the aforesaid unit of measurement, they are converted so as to be able to make the calculation.

The result is then the angle θ_CL,E, which will be in advance with respect to θ_OP,CA by an amount equal to (T_NOM,CL+DEL_COMP−C_COMP,CL), as described previously.

A similar computation logic is adopted for determining the crank angle θ_OP,E, at which sending of the electrical signal to the solenoid valve 11 ceases.

However, in this case, there are various physical quantities involved in the calculation. The calculation is represented schematically by block CL, which possesses as input variables, as a function of which the angle θ_OP,E is determined:

the temperature of the oil inside the solenoid valve T_OIL,SV;

the value of crank angle θ_CL,CA, engine r.p.m. n; and the temperature of the oil in the actuator T_OIL,AC.

The temperature of the oil T_OIL,SV within the solenoid valve 11 concurs in determining a nominal opening time of the solenoid valve 11 designated by T_NOM,OP.

The reason for this is that opening of the solenoid valve 11, which is normally in the open position, does not require energization of the solenoid; consequently, the movement of the mobile parts of the solenoid valve 11 depends mostly upon the physical characteristics of the oil inside the solenoid valve itself.

In this case, the temperature is chosen as parameter representing the physical characteristics of the oil as a whole.

The temperature of the oil inside the actuator T_OIL,AC and the engine r.p.m. n concur, instead, in determining the angular interval in which ballistic closing of the valves 2 occurs, here designated by BAL_FL.

As is known, closing of the valves 2 as a result of an opening of the solenoid valve 11 occurs ballistically; namely, it is determined by the initial action of the springs 3, by the inertia of the valves 2 and by the viscous friction within the actuators 4, which are equipped with a hydraulic brake, as described previously.

Precisely the latter dissipative component of the motion of the valves 2 is affected by the temperature of the oil in the actuators 4, which affects the dynamics of the mobile parts within the actuators 4 themselves.

The values T_NOM,OP and BAL_FL thus determined are subtracted from the crank angle θ_CL,CA and added to the result of said operation is a quantity corresponding to a closed-loop compensation of the difference between the nominal opening time t_NOM,OP and an opening time measured for each solenoid valve. The amount of compensation is here designated by the reference C_COMP,OP and is expressed in degrees of crank angle. It should be noted that also the values T_NOM,OP and BAL_FL are expressed in terms of degrees of crank angle, where this is intended to indicate also that, in the case where the physical dimensions of said quantities do not correspond to the aforesaid unit of measurement, they are converted so as to be able to make the calculation.

The final result is the angle θ_OP,E, at which sending of the electrical signal to the solenoid valve 11 ceases. Said value will be phase shifted in advance with respect to the angle θ_CL,CA by an amount equal to (T_NOM,OP+BAL_FL−C_COMP,OP).

The effectiveness of said control strategy is, however, bound to decay in time. In the case in point, the determination of all the quantities that intervene in the calculation and that depend more or less directly upon the temperature of the oil in the solenoid valve and/or in the actuators 4 has a degree of accuracy that is bound to decay on account of ageing and degradation of the oil.

It happens, in fact, that, given the same temperature, an oil in nominal conditions (i.e., a "new" oil, just poured into the internal-combustion engine) and an oil in degraded conditions can cause dynamic behaviours of the solenoid valve 11 and of the actuator 4 that are even markedly different.

This may to a varying extent jeopardize effectiveness of operation of the entire variable valve-control system and of the internal-combustion engine itself, since for example the values of crank angle at which desired events of opening and closing of the valves 2 have been mapped in nominal conditions of the oil (i.e., new oil) and have been chosen so as to guarantee the lowest levels of consumption or else the best performance, as a function of the corresponding operating point of the internal-combustion engine.

The oil present in the engine can be degraded to such a point as to produce a different dynamic behaviour of the solenoid valve 11 and of each actuator 4.

In fact, it is not only the behaviour of the solenoid valves 11 that is affected by the degradation of the characteristics of the oil, but also (and to a non-negligible extent) all the hydraulic and mechanical components that are involved in the ballistic motion of the valves 2, in the case in point the actuators 4.

All this results generally in intervals of opening of the valves 2 that are markedly different from the ones envisaged during calibration, with consequent repercussions on the efficiency of the engine. This leads, according to the engine operating point and the drifts in performance in progress, higher consumption levels and/or lower performance, with evident dissatisfaction on the part of the user.

OBJECT OF THE INVENTION

The object of the present invention is to overcome the technical problems described previously. In particular, an object of the invention is to provide a method for controlling a system for variable-lift actuation of the valves for an internal-combustion engine of a reciprocating type, in which it will be possible to compensate for the errors and effects due to degradation of the oil during engine life.

SUMMARY OF THE INVENTION

The object of the invention is achieved by a method and by an internal-combustion engine having the characteristics forming the subject of the ensuing claims. The claims form an integral part of the description and of the technical teaching provided herein in relation to the present invention.

In particular, the object of the present invention is achieved by a method having all the characteristics specified at the start of the present description and moreover characterized in that it comprises the following steps:

- determining a deviation of performance of the solenoid valves of said reciprocating internal-combustion engine due to a degradation of the characteristics of said hydraulic fluid with respect to nominal values thereof;
- substituting for said real temperature value an equivalent temperature value consisting of a temperature at which the hydraulic fluid having nominal characteristics would produce performance of the solenoid valves corresponding to the performance resulting from the aforesaid deviation so that each solenoid valve is governed as a function of said equivalent temperature value instead of the real temperature value of the hydraulic fluid.

Said method is preferably implemented on a reciprocating internal-combustion engine including a valve-control system for variable-lift actuation of the valves comprising, for each cylinder of the reciprocating internal-combustion engine:

- one or more valves including a respective hydraulic actuator for actuation thereof;
- a pumping unit prearranged for sending hydraulic fluid to each hydraulic actuator through a hydraulic supply line;
- a cam configured for actuation of each pumping unit; and
- a solenoid valve configured for selectively isolating or setting in communication said hydraulic supply line and an exhaust environment, said solenoid valve being governed as a function of said equivalent value of temperature of said hydraulic fluid.

BRIEF DESCRIPTION OF THE DRAWINGS

The invention will now be described with reference to the annexed figures, which are provided purely by way of non-limiting example and in which.

DETAILED DESCRIPTION OF THE INVENTION

Figure 2:
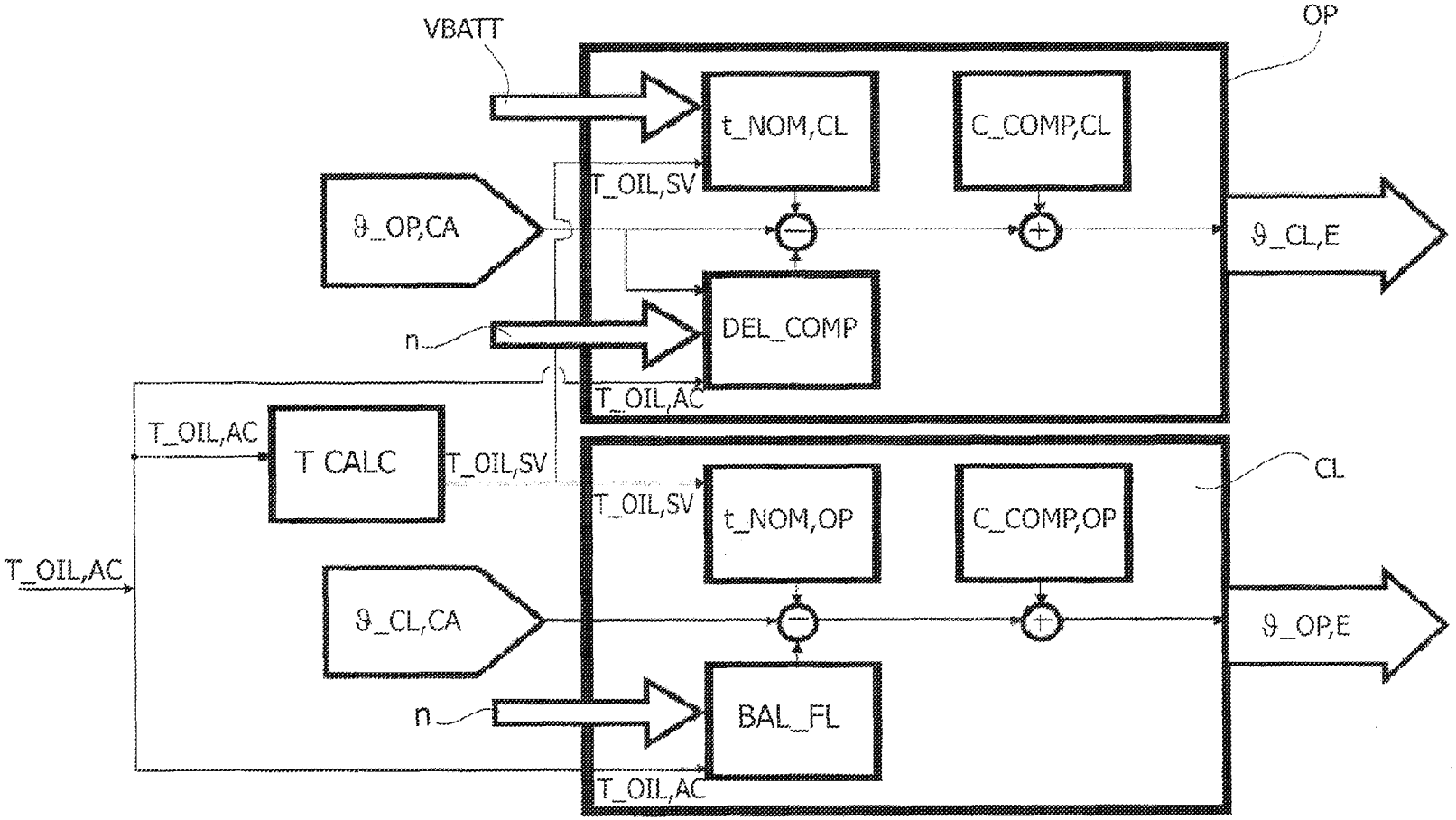
FIG. 2 Prior Art
FIG. 2, described previously, illustrates a block diagram of a known calculation algorithm for control of the valve-control system with variable valve lift of FIG. 1.
Figure 3:
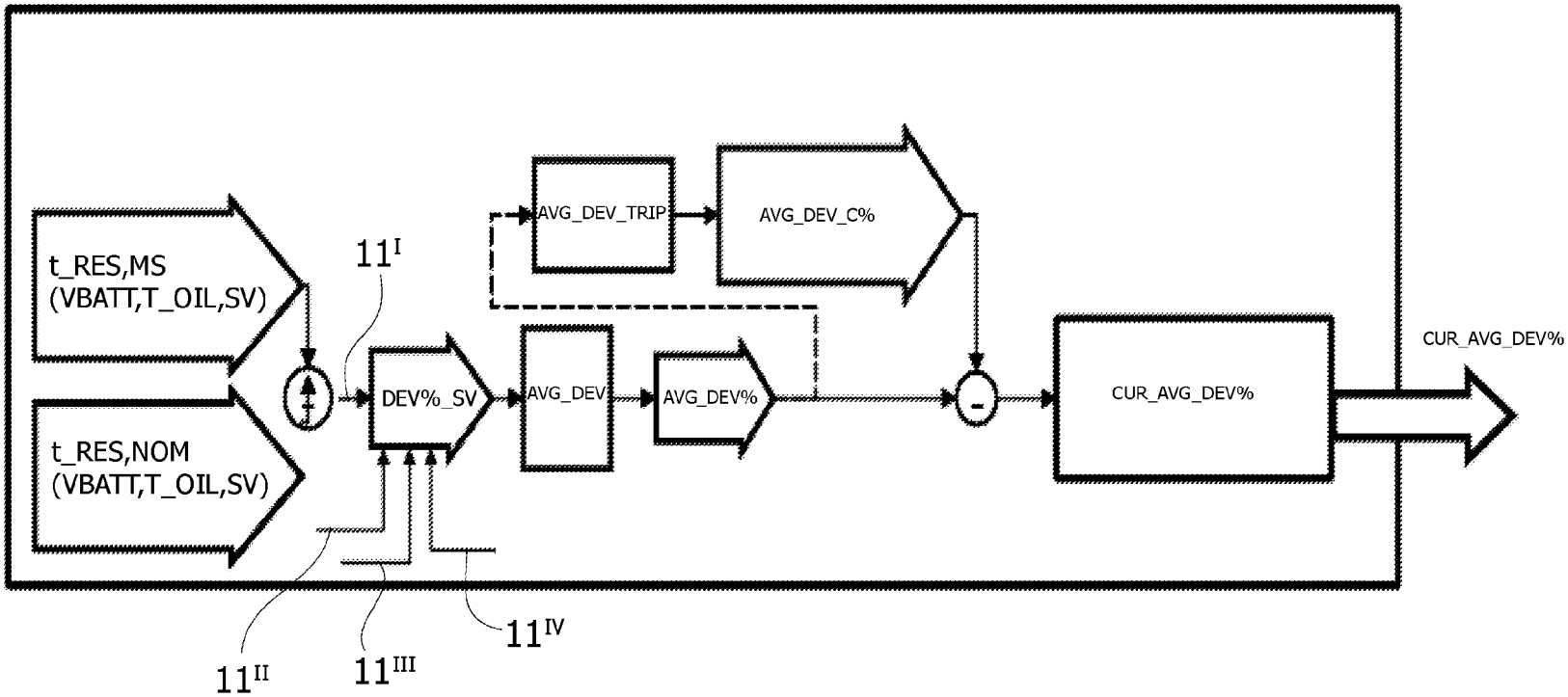
FIG. 3 is a representation by means of a block diagram of a first fraction of a method according to the invention.
Figure 4:
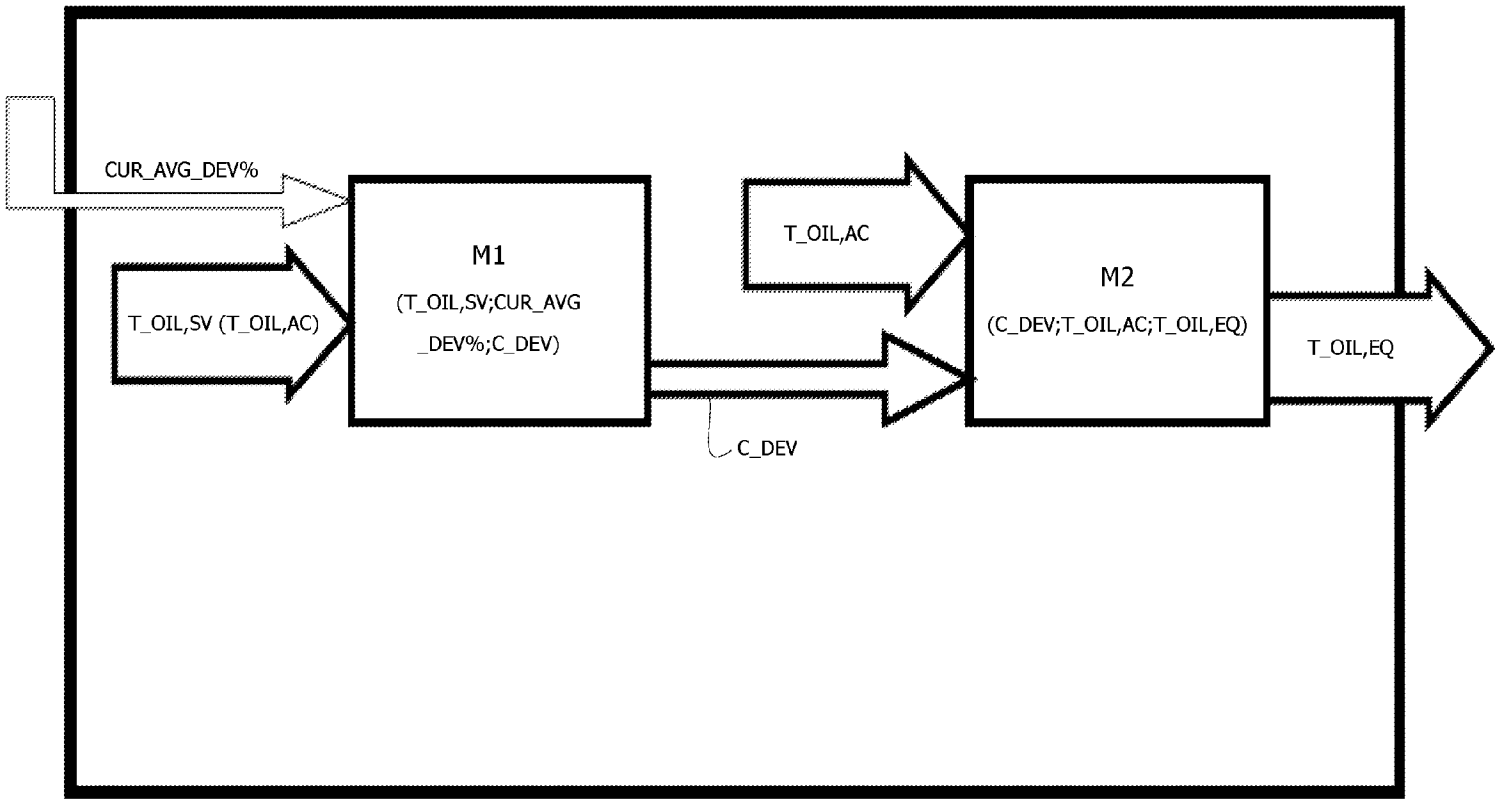
FIG. 4 is a representation by means of a block diagram of a second fraction of the method according to the invention.
Figure 5:
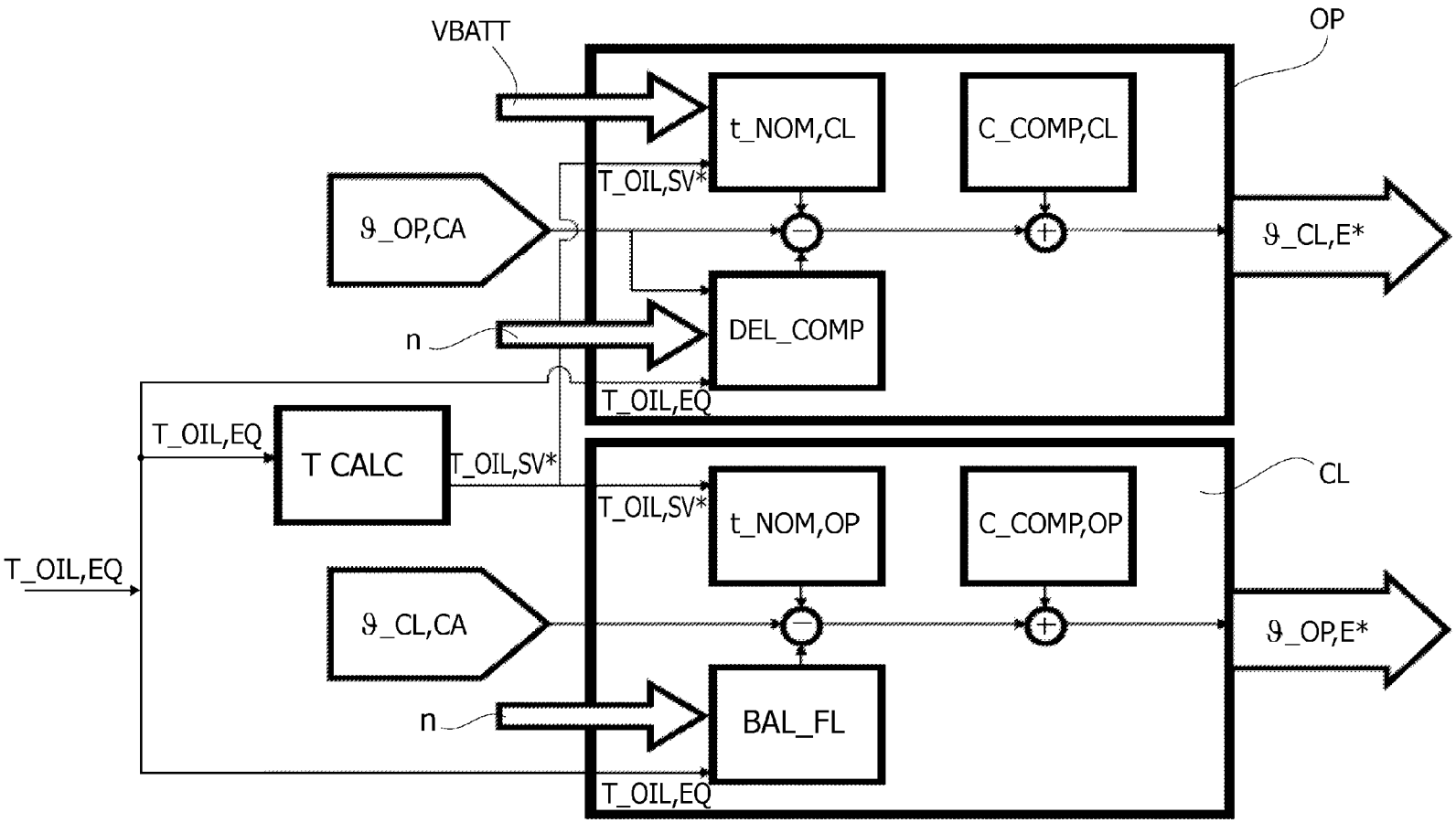
FIG. 5 illustrates via block diagram a third fraction of the method according to the invention.

The calculation method according to the invention is represented schematically in a sequential way in FIGS. 3 and 4. In extreme synthesis, the purpose of the calculation method according to the invention is to modify the input value T_OIL, AC in the block diagram of FIG. 2, substituting it as represented in FIG. 5 with an equivalent value T_OIL,EQ, the calculation and physical meaning of which will shortly be described in detail.

With reference to FIG. 3, the method according to the invention comprises a first step in which there is brought about a deviation of performance of the solenoid valves 11 due to a degradation of the characteristics of the oil with respect to nominal values thereof.

The indicator of performance chosen for the calculation is the response time of the solenoid valve 11 of each cylinder of the internal-combustion engine.

In particular, two characteristic response times are compared, in the case in point:

- a measured response time of the solenoid valve 11, which is designated in the diagram of FIG. 3 by t_RES,MS and is a function of the voltage across the battery VBATT and of the temperature of the oil inside the solenoid valve T_OIL,SV;
- a nominal response time of the solenoid valve 11 designated in the diagram of FIG. 3 by t_RES,NOM, which is a function of the battery voltage VBATT and of the temperature of the oil inside the solenoid valve T_OIL, SV.

The nominal response time is an average value for the solenoid valves of a given lot detected with new, i.e., not yet degraded, oil. Instead, the measured response time corresponds to a photograph of the performance of a single solenoid valve 11 at any instant of its life and is a datum that is detected in each cycle of the internal-combustion engine thanks to a method for detection of the end of stroke normally implemented in control systems for variable-lift actuation of the valves of an internal-combustion engine that use one or more solenoid valves. An example of said method is described in EP 2 072 791 A1, filed in the name of the present applicant.

The knowledge of the measured and nominal response times t_RES,MS, t_RES,NOM for each solenoid valve 11 enables calculation of a percentage deviation of the response times for each individual solenoid valve, designated by DEV%_SV. Said value evidently corresponds to the ratio of the difference between T_RES,MS and T_RES,NOM and of the value T_RES,NOM, multiplied of course by a hundred (i.e., the entire ratio).

The calculation is made separately for each solenoid valve, as represented by the arrows $\mathbf{11}^{I}$, $\mathbf{11}^{II}$, $\mathbf{11}^{III}$, $\mathbf{11}^{IV}$ corresponding to the same calculation made for four solenoid valves 11 on a four-cylinder engine.

With the values of percentage deviation DEV%_SV of each individual solenoid valve 11 a value of average deviation AVG_DEV is calculated on all the solenoid valves 11, as represented schematically by a block of the same name (AVG_DEV).

The average value calculated on all the solenoid valves is then converted into an average percentage deviation AVG_DEV%.

Alongside this, during a reference interval that starts (and in general is located) in the proximity of the start of life of the vehicle on which the engine is installed or else in the proximity of an event of oil change, the datum of average percentage deviation is recorded for each operating interval of the internal-combustion engine. In the diagram of FIG. 3 it is designated by AVG_DEV_TRIP.

By averaging over said reference interval the data of average deviation AVG_DEV_TRIP recorded during the aforesaid intervals of operation of the engine, a characteristic average percentage deviation AVG_DEV_C% is determined, which represents a deviation in performance of the solenoid valves due to factors extraneous to the degradation of the characteristics of the oil (i.e., to the degradation of the oil) with respect to the nominal values, such as for example the dispersion with respect to the characteristics envisaged in the design stage for the solenoid valves 11 typical of a production process.

It should be noted that the reference interval in which the average values of deviation in performance of the solenoid valves 11 are recorded is chosen in such a way as to start at an instant of time in which the operating play of the system has already settled. The experimental evidence shows that the variation of performance due to the modification of the operating play of the solenoid valve undergoes a rather sudden variation in the first instants of life of the engine and then settles on substantially constant values throughout the life of the engine itself.

The characteristic average percentage deviation AVG_DEV_Co is then compared, once determined, with the value of average percentage deviation AVG_DEV% of the solenoid valves 11 calculated at each cycle of the engine.

In this way, by subtracting from the value of deviation in performance AVG_DEV% calculated at each cycle all the contributions due exclusively to factors extraneous to the degradation of the characteristics of the oil with respect to the nominal values (i.e., AVG_DEV_C%), a current average percentage deviation of the performance of the solenoid valve CUR_AVG_DEV% is immediately obtained, which thus represents phenomena of degradation in performance due substantially in a unique and exclusive way to the degradation of the characteristics of the oil with respect to the nominal characteristics. Said datum (CUR_AVG_DEV%) is an input variable for the subsequent fraction of the method according to the invention, represented schematically in FIG. 4.

Figure 6:
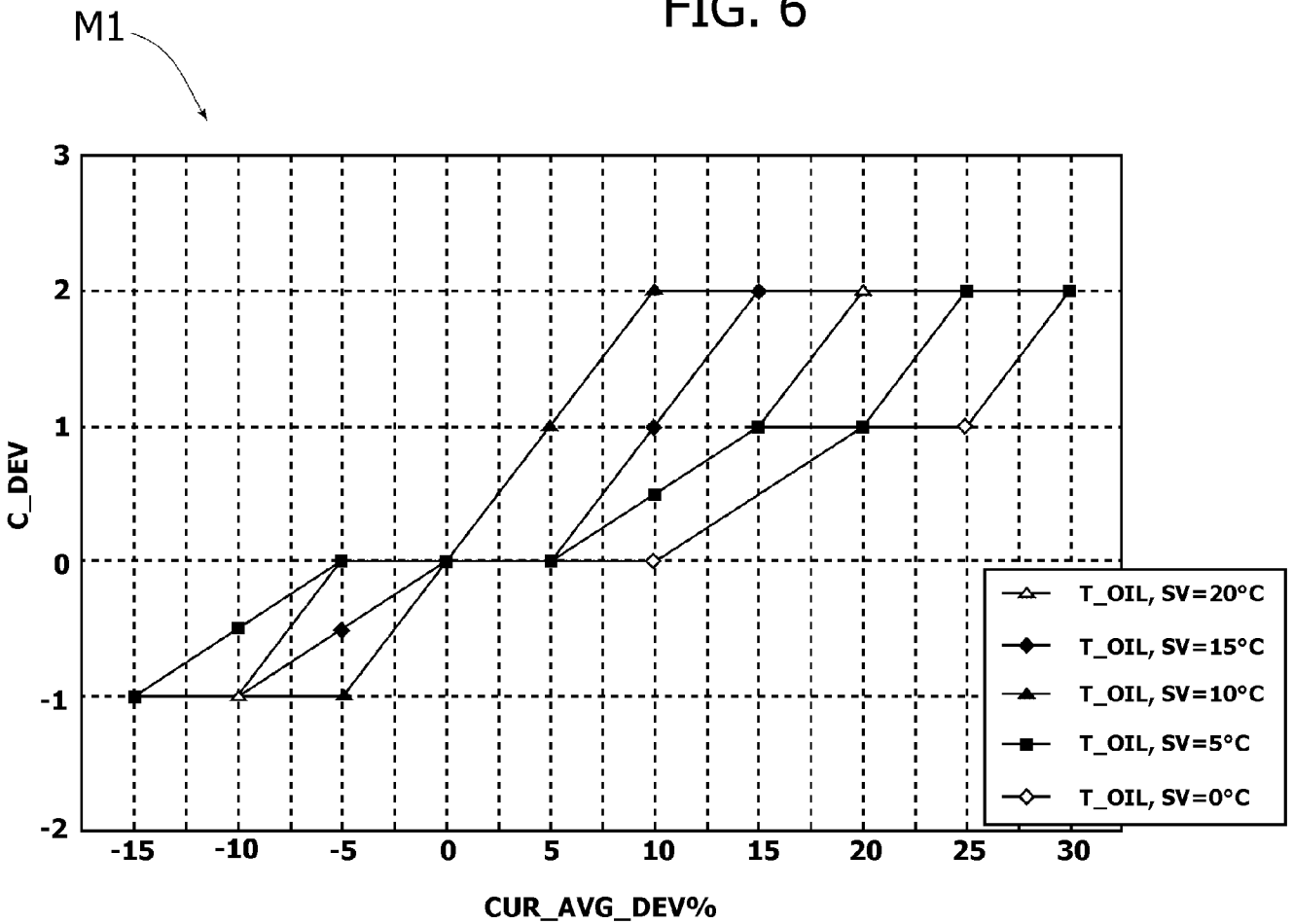
FIGS. 6 and 7 illustrate diagrams of quantities that intervene in the calculation represented in the block diagram of FIG. 4.

With reference then to FIG. 4, the value of current average percentage deviation CUR_AVG_DEV% is used for locating, on a map represented schematically by a block M1, a corresponding value of a class of deviation of the oil with respect to the nominal values. In greater detail, with reference moreover to FIG. 6, the map M1 is a three-dimensional surface that interpolates a series of points obtained experimentally and by means of which it is possible, having as input data the current average percentage deviation CUR_AVG_DEV% and the temperature of the oil inside the solenoid valve T_OIL,SV (which is in turn determined as a function of the temperature of the oil in the actuator T_OIL,AC), a value C_DEV that corresponds to a class of deviation of the oil with respect to the nominal values. The class of deviation is an indicator of variation of the characteristics of the hydraulic fluid, and the physical meaning of the parameter C_DEV is that of an interval corresponding to a given degree of degradation of the characteristics of the oil at a given temperature. To understand this better, FIG. 6 presents a projection of the map M1 in a plane having an independent variable on the abscissae, in the case in point CUR_AVG_DEV%, and a dependent variable on the ordinates, in the case in point C_DEV. The projection consists of a series of curves parametrized as a function of the temperature T_OIL,SV.

Figure 7:
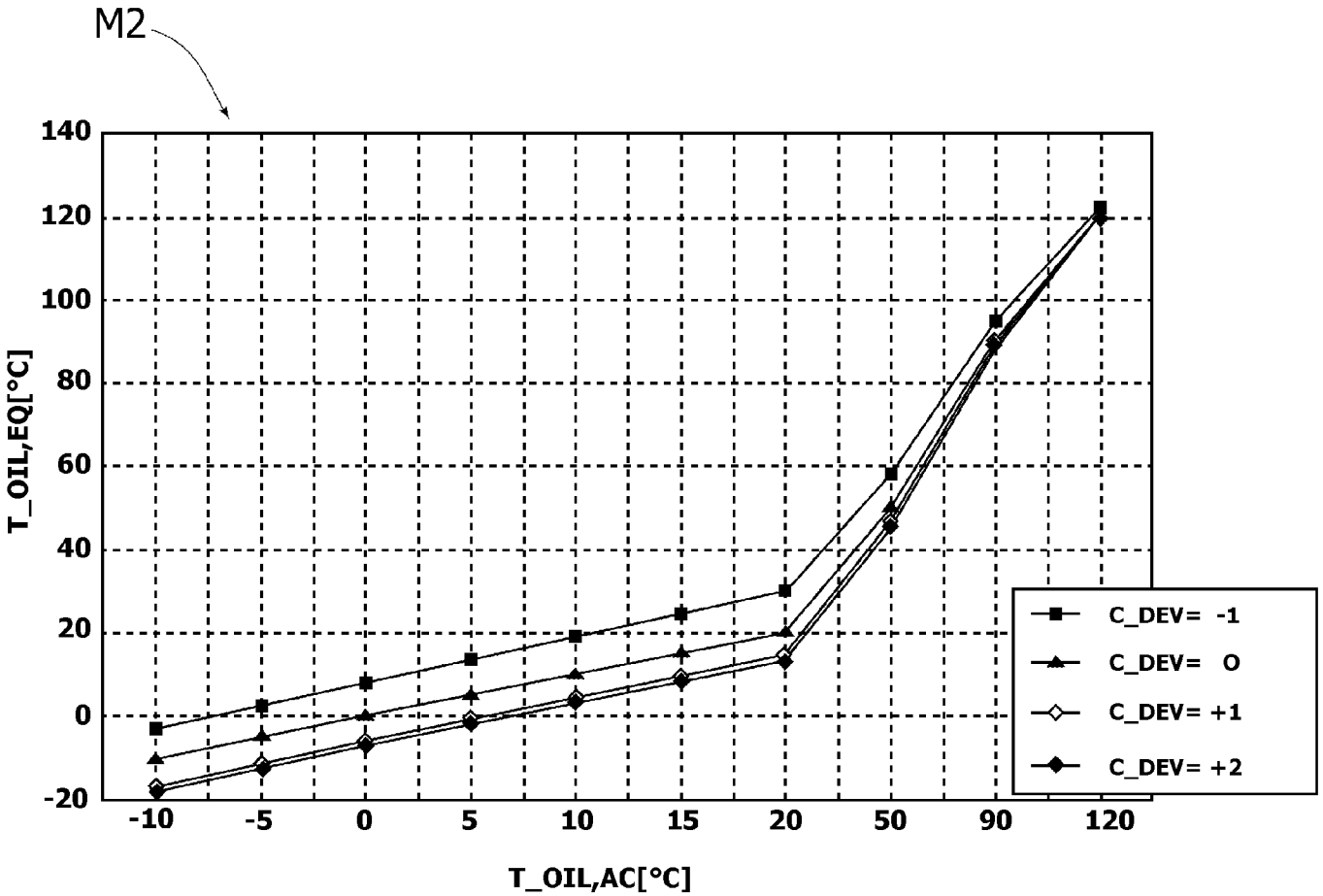

The class of deviation C_DEV thus determined, as well as the datum of temperature of the oil inside the actuator T_OIL, AC, are subsequently used as pair of input data for locating a point corresponding to an equivalent oil temperature T_OIL, EQ on a second map M2, illustrated in FIG. 7.

The map M2, like the map M1, is a three-dimensional surface that interpolates a series of experimental points and has as independent variables the temperature of the oil in the actuator T_OIL,AC and the class of deviation C_DEV. The dependent variable is of course the equivalent oil temperature T_OIL,EQ.

The physical meaning of the equivalent oil temperature is the following: this is the temperature at which an oil in nominal conditions (i.e., "new" oil) should be for the system 1 to present a performance altered in the same way as occurs as a result of a deterioration of the characteristics of the oil.

More precisely, the equivalent oil temperature T_OIL,EQ consists of a (virtual) temperature value at which the hydraulic fluid having nominal characteristics would produce performance of the solenoid valves corresponding to the performance resulting from the deviation due, as has been said, to the degradation of the characteristics of the hydraulic fluid with respect to the nominal values thereof.

In other words, given that the dynamics of the solenoid valves 11 is affected by the deterioration of the characteristics of the oil and that the determination of the angles θ_CL,E and θ_OP,E is made on the basis, among other things, of the temperature of the oil in the actuators T_OIL,AC, the method according to the invention supplies to the control unit of the valve-control system a temperature value that is deliberately erroneous (deviated) with respect to the value actually detected by the temperature-sensor means TS.

In conclusion, the equivalent oil temperature T_OIL,EQ corresponds to a temperature of an oil in nominal conditions that determines the same levels of performance of the solenoid valves 11 as the ones detected in the real system with degraded oil, i.e., resulting from the deviation due to a degradation of the characteristics of the oil.

The method according to the invention results in the block diagram of FIG. 5, which is altogether equivalent to the block diagram of FIG. 2, except for the input datum of oil temperature. In fact, the method according to the invention envisages that the real value of oil temperature (in particular, the temperature in the actuator T_OIL,AC) is replaced with the equivalent value of oil temperature T_OIL,EQ.

This reflects, amongst other things, in the calculation of the temperature of the oil inside the solenoid valve, which in this case is designated by T_OIL,SV* and is calculated as a function of the equivalent value of oil temperature T_OIL,EQ. Thus also the value T_OIL,SV* is deviated with respect to the (real)value T_OIL,SV calculated on the basis of the known method (FIG. 2) in so far as it stems from a "virtual" value of temperature of the oil in the actuator 4 (T_OIL,EQ) instead of from the real value (T_OIL,AC).

The values of the angles θ_CL,E and θ_OP,E in the diagram of FIG. 5 are hence replaced by the values θ_CL,E* and θ_OP,E*, which have the same physical meaning but result from the datum of equivalent (virtual) oil temperature T_OIL, EQ at input to the system.

In this way, it may be stated that, thanks to the replacement of the real value of oil temperature (in particular T_OIL,AC) with the equivalent temperature value T_OIL,EQ implemented by means of the method according to the invention, each solenoid valve 11 is governed as a function of the equivalent temperature value T_OIL,EQ instead of the real temperature value T_OIL,AC of the hydraulic fluid.

This has an impact on the entire control chain by means of which calculation of the angles θ_CL,E* and θ_OP,E* and actuation of the solenoid valves 11 and of the valves 2 is carried out.

In particular, the replacement of the real temperature value T_OIL,AC with the equivalent temperature value T_OIL,EQ also has an impact on the quantities DEL_COMP and BAL_FL. Said quantities in the known method are in fact determined precisely as a function of the temperature T_OIL, AC, now replaced by the equivalent oil temperature T_OIL, EQ (FIG. 5) on the basis of the method according to the invention.

Apart from this, the angles θ_CL,E* and θ_OP,E* are determined with modalities that are altogether identical to what has been already described in FIG. 2 for the angles θ_CL,E and θ_OP,E. For this reason, the diagram of FIG. 5 will not be described again in detail in so far as the description would be substantially identical to what has already been proposed for FIG. 2 (all the references identical to the ones adopted previously designate the same physical quantity or quantities).

In practice, in addition to the traditional compensations as a function of:

engine r.p.m.;

battery voltage;

ballistic-closing times; and compressibility of the oil, and to the closed-loop compensations of the difference between the nominal response time and the measured response time (of closing or opening) for each solenoid valve 11 that have been described in connection with FIG. 2, the values of crank angle θ_CL,E* and θ_OP,E* are moreover affected by the compensation of the oil-deterioration effects that is introduced by the fictitious temperature datum T_OIL,EQ calculated by means of the method according to the invention.

Finally, it should be noted that the temperature value T_OIL,AC read by the temperature-sensor means TS positioned in the actuators 4 (or determined via the aforesaid estimation methods), in this case is not among the physical parameters that directly enter into the calculation of the angles θ_CL,E* and θ_OP,E*, but has only the purpose of determining the class of deviation C_DEV.

It may hence be concluded that the provision of sensors normally on board the vehicle (or possibly some of the calculation algorithms—in particular the ones that enable estimation of the temperature of the hydraulic fluid in the system for control of the valves 2—stored in the control unit) is exploited, on the basis of the method according to the invention, for determining the conditions of an equivalent virtual physical system operating with oil in nominal conditions at a fictitious temperature that is the result of the aggregation of the deviations in performance that can be put down to the degradation of the characteristics of the oil in the real system.

Of course, the details of construction and the embodiments may vary widely with respect to what has been described and illustrated herein, without thereby departing from the sphere of protection of the present invention, as defined by the annexed claims.

In particular, it is possible to apply the method according to the invention for control of a valve-control system with variable valve lift of any reciprocating internal-combustion engine, irrespective of the number and arrangement of the cylinders, as well as irrespective of the type of ignition and supply.

Figure 1:
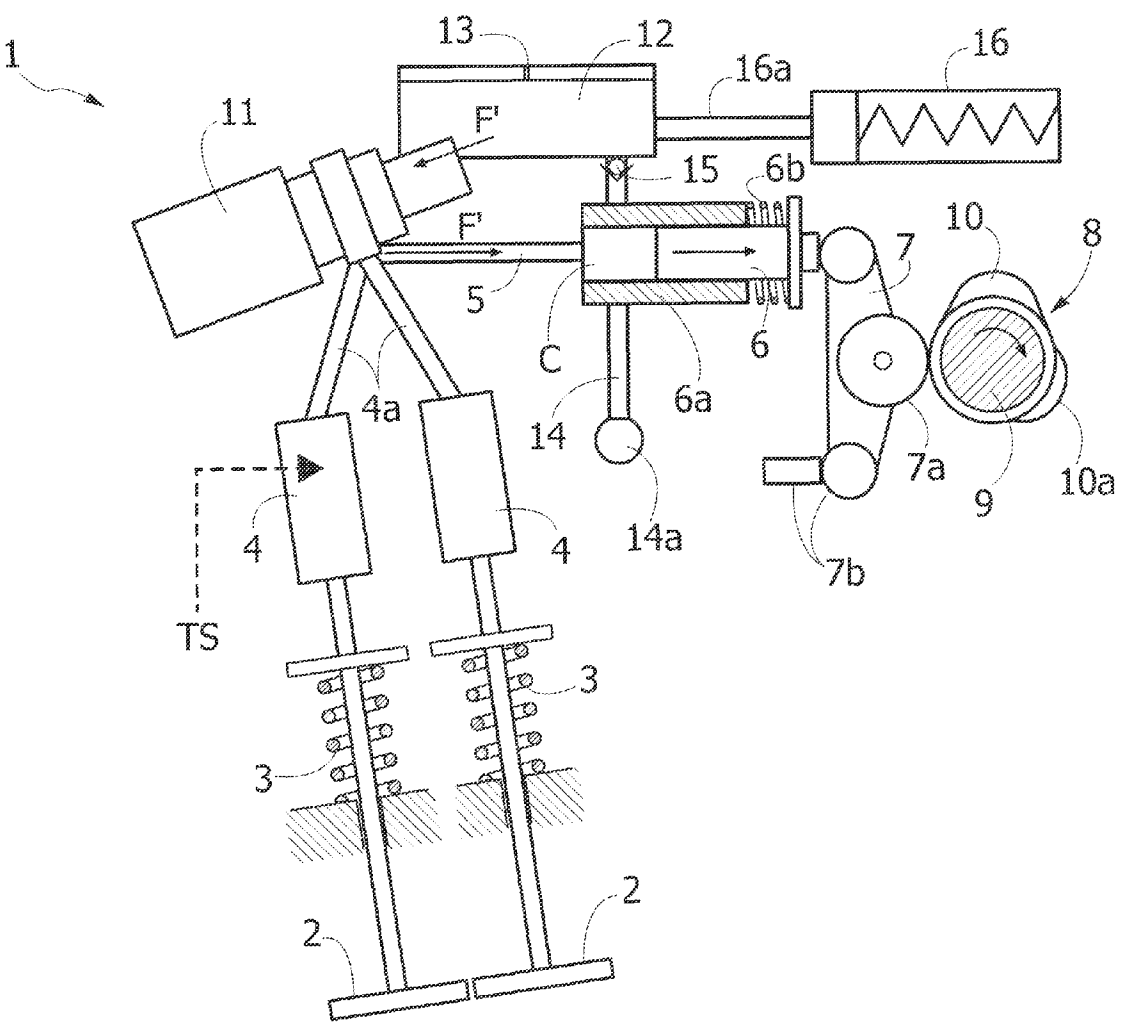
FIG. 1 Prior Art
FIG. 1, described previously, is a schematic view provided by way of example of a valve-control system with variable valve lift for a reciprocating internal-combustion engine.

Moreover, the embodiment of the valve-control system illustrated schematically in FIG. 1 is to be deemed as being provided purely by way of non-limiting example. Numerous other variants of said system are known and have been proposed by the present applicant, and the method according to the invention can be implemented on any one of said variants. It is likewise perfectly equivalent to apply the method according to the invention to intake valves or exhaust valves of the internal-combustion engine.

What is claimed is:

1. A method for controlling a valve-control system for variable-lift actuation of the valves of a reciprocating internal-combustion engine, wherein said valve-control system comprises, for each cylinder of said reciprocating internal-combustion engine, a solenoid valve for controlling the flow of a hydraulic fluid in said valve-control system, and further comprises means configured for determining a real temperature value of said hydraulic fluid, the method being characterized in that it comprises the steps of:

determining a deviation of performance of the solenoid valves of said reciprocating internal-combustion engine due to a degradation of the characteristics of said hydraulic fluid with respect to nominal values thereof;

substituting for said real temperature value an equivalent temperature value consisting of a temperature value at which the hydraulic fluid having nominal characteristics would produce a performance of the solenoid valves corresponding to the performance resulting from the aforesaid deviation so that each solenoid valve is governed as a function of said equivalent temperature value instead of as a function of the real temperature value of the hydraulic fluid.

2. The method according to claim 1, wherein the step of determining a deviation of performance of the solenoid valves in turn comprises the following steps:

comparing a first response time and a second response time characteristic of each solenoid valve, said first and second characteristic response times including a measured response time of each solenoid valve and a nominal response time of each solenoid valve;

calculating a percentage deviation of the response times for each individual solenoid valve;

calculating a value of average percentage deviation on all the solenoid valves;

calculating a characteristic average percentage deviation representing a deviation in performance of the solenoid valves due to factors extraneous to degradation of said hydraulic fluid; and calculating a current average percentage deviation of the performance of the solenoid valves subtracting from said average value of percentage deviation the characteristic average percentage deviation.

3. The method according to claim 2, wherein said step of calculating a characteristic average percentage deviation includes recording, during a reference interval and for each operating interval of the engine, the average deviation value and subsequently averaging the average deviation values over said reference interval, wherein said reference interval starts in the proximity of the start of life of a vehicle on which the reciprocating internal-combustion engine is installed or else in the proximity of an event of replacement of the hydraulic fluid and terminates after a pre-set number of cycles of operation of said reciprocating internal-combustion engine, said reference interval being placed in any case in the proximity of said start of life or of said event of replacement of the hydraulic fluid.

4. The method according to claim 1, further comprising, following upon said step of determining a deviation of performance of the solenoid valves, a step of determining an indicator of variation of the characteristics of said hydraulic fluid.

5. The method according to claim 4, wherein said step of determining an indicator of variation of the characteristics of said hydraulic fluid includes determining, as a function of the real temperature value of the hydraulic fluid and as a function of said current average percentage deviation of the performance of the solenoid valves, a class of deviation of the characteristics of said hydraulic fluid with respect to the nominal values, said class of deviation defining said indicator of variation of the characteristics of the hydraulic fluid.

6. The method according to claim 5, wherein said real temperature value corresponds to the temperature value in each solenoid valve.

7. The method according to claim 6, wherein the temperature value in each solenoid valve is calculated as a function of a temperature value in a hydraulic actuator of a valve of a cylinder of said reciprocating internal-combustion engine.

8. The method according to claim 5, further comprising the step of determining, as a function of said class of deviation and of said real temperature value, said equivalent temperature value of said hydraulic fluid.

9. The method according to claim 8, wherein said real temperature value corresponds to the temperature value in a hydraulic actuator of a valve of a cylinder of said reciprocating internal-combustion engine.

10. The method according to claim 1, wherein said means configured for determining the real temperature value of the hydraulic fluid comprise one between, or both of, the following alternatives:

a sensor of the temperature of said hydraulic fluid; and an algorithm for estimating the temperature of the hydraulic fluid on the basis of operating parameters of said reciprocating internal-combustion engine, said operating parameters preferably including engine r.p.m. and the temperature of a cooling liquid of said reciprocating internal-combustion engine.

11. A reciprocating internal-combustion engine including a valve-control system for variable-lift actuation of the valves controlled by means of the method according to claim 1, wherein said valve-control system comprises, for each cylinder of said reciprocating internal-combustion engine:

one or more valves including a respective hydraulic actuator for actuation thereof;

a pumping unit prearranged for sending hydraulic fluid to each hydraulic actuator through a hydraulic supply line;

a cam configured for actuation of each pumping unit; and a solenoid valve configured for, selectively, isolating or setting in communication said hydraulic supply line and an exhaust environment, said solenoid valve being governed as a function of said equivalent value of temperature of said hydraulic fluid.

12. The reciprocating internal-combustion engine according to claim 11, wherein, given a value known of crank angle at which there is required an opening of said one or more valves of a cylinder, means are provided for calculating a value of crank angle at which an electrical signal is imparted to a corresponding solenoid valve as a function of:

an equivalent value of temperature of the hydraulic fluid;

a value of temperature of the hydraulic fluid in the solenoid valve calculated as a function of said equivalent temperature value;

an r.p.m. of the internal-combustion engine; and a voltage across a battery connected to said reciprocating internal-combustion engine.

13. The reciprocating internal-combustion engine according to claim 12, wherein the value of crank angle at which an electrical signal is imparted to said solenoid valve is calculated by subtracting from the value of the crank angle at which there is required opening of said one or more valves of a cylinder the following quantities:

a nominal closing time of the solenoid valve; and a closing delay of the solenoid valve due to the compressibility of the hydraulic fluid; and and finally adding a term of closed-loop compensation of the difference between said nominal closing time and a closing time measured for each solenoid valve.

14. The reciprocating internal-combustion engine according to claim 11, wherein, given a known value of crank angle at which there is required a closing of said one or more valves of a cylinder, means are provided for calculating a value of crank angle at which sending of an electrical signal to a corresponding solenoid valve ceases as a function of:

said equivalent value of temperature of the hydraulic fluid;

a temperature value of the hydraulic fluid in the solenoid valve calculated as a function of said equivalent temperature value; and a speed of rotation of the internal-combustion engine.

15. The reciprocating internal-combustion engine according to claim 14, wherein the value of crank angle at which sending of an electrical signal to said solenoid valve ceases is calculated by subtracting from the value of the crank angle at which there is required a closing of said one or more valves of a cylinder, the following quantities:

a nominal opening time of the solenoid valve; and an angular interval of ballistic closing of said one or more valves;

and finally adding a term of closed-loop compensation of the difference between the nominal opening time and an opening time measured for each solenoid valve.

* * * * *